US005682691A

United States Patent [19]

Mayer et al.

[11] Patent Number: 5,682,691

[45] Date of Patent: Nov. 4, 1997

[54] WALL-MOUNTABLE IRONING BOARD

[76] Inventors: Alain Mayer; Suzanne Laflamme, both of 11, rue Perrier, Laprairie, Québec, Canada, J5R 5X9

[21] Appl. No.: 658,246

[22] Filed: Jun. 4, 1996

[51] Int. Cl.[6] ..... D06F 81/00; D06F 81/06

[52] U.S. Cl. ..... 38/137; 108/48

[58] Field of Search ..... 38/137, 139, 138, 38/140, 1 A; 108/42, 48, 115, 134; 312/242, 245, 247, 248

[56] References Cited

U.S. PATENT DOCUMENTS

| | | | |
|---|---|---|---|
| 1,257,116 | 2/1918 | Ramm | 38/137 X |
| 1,547,309 | 7/1925 | Eastwood | 108/28 |
| 1,590,241 | 6/1926 | Grzeszkiewicz . | |
| 1,725,614 | 8/1929 | Bryan | 38/140 X |
| 1,740,183 | 12/1929 | Lenney et al. | 38/137 X |
| 2,291,614 | 8/1942 | Fay | 38/137 |
| 2,325,493 | 7/1943 | Fay | 38/137 |
| 2,475,106 | 7/1949 | Mohr et al. | 38/137 |
| 2,539,804 | 1/1951 | Adamec | 38/107 |
| 3,641,947 | 2/1972 | Finney | 108/38 |
| 4,565,021 | 1/1986 | Kay et al. | 38/137 |
| 4,779,539 | 10/1988 | Stiglich | 108/48 |
| 4,862,611 | 9/1989 | Wright | 38/103 |
| 4,909,158 | 3/1990 | Sorensen | 108/40 |
| 4,995,681 | 2/1991 | Parnell | 312/242 |
| 5,369,898 | 12/1994 | Sorensen | 38/137 |

*Primary Examiner*—Ismael Izaguirre

*Attorney, Agent, or Firm*—David M. Klein; Bryan Cave LLP

[57] ABSTRACT

The wall-mountable ironing board for use with an ironing cloth comprises a top panel provided with a peripheral flange defining a housing underneath and a bottom panel sized to closely fit into the housing of the top panel, whereby the ironing cloth skirting the top panel is clampable between the top and bottom panel. The rear end of the top panel is pivotally secured to a wall such that the ironing board is pivotable between a service position and a storage position. The ironing board is also provided with a support member secured under the board for maintaining the ironing board in a service position and a locker for maintaining the ironing board in a storage position. The ironing board according to the present invention allows to easily clamp and hide the hanging skirt of an ironing cloth between the top and bottom panel of the ironing board. Thereby, the ironing board is aesthetically advantageous.

8 Claims, 4 Drawing Sheets

WALL-MOUNTABLE IRONING BOARD

FIELD OF THE INVENTION

The present Invention relates to an ironing board and more particularly to a wall-mountable ironing board for use with an ironing cloth.

BACKGROUND OF THE INVENTION

Conventional ironing boards which are mounted on a wall and move between a service position and a storage position are already known in the art. A drawback with these ironing boards is that they are generally very cumbersome and do not allow to neatly hide the ironing cloth hanging under the ironing board as the board is in a storage position. Therefore, they are generally mounted inside a wardrobe and are not very practical.

There is thus presently a need for a wall-mountable ironing board which is very simple to use, low in cost and which allows to easily attach or hide an ironing cloth or the like under the ironing board.

SUMMARY OF THE INVENTION

An object of the present invention is to propose a wall-mountable ironing board which satisfies these needs. More particularly, the object of the present invention is to provide a wall-mountable retractable ironing board for use with an ironing cloth or the like and comprising:

- a first panel provided with a peripheral flange defining a housing underneath;
- a second panel sized to closely fit into the housing of the first panel, one of the first and second panel defining a working surface of the ironing board;
- means for removably securing the second panel to the first panel;
- pivoting means for pivotally securing a rear end of the first panel to a wall such that the ironing board is pivotable between a substantially horizontal position and a substantially vertical position;
- means for maintaining the ironing board in the horizontal position; and
- means for locking the ironing board in the vertical position; whereby an ironing cloth skirting the working surface is clampable between the first and second panel.

According to a preferred embodiment, the first panel is a top panel of the ironing board and is defining the working surface mentioned above and the second panel is the bottom panel, and the ironing board further comprises means for pivotally fastening the rear end of the top panel to a rear end of the bottom panel such that these panels are pivotable about their rear end between a closed position where the bottom panel is extending in the housing of the top panel and an open position where the panels are defining an angle therebetween.

According to another preferred embodiment, the bottom panel is provided with a peripheral flange projecting upwardly therefrom thereby making the ironing board hollow when the panels are in the closed position mentioned above.

Also preferably, the means for securing the bottom panel to the top panel in the closed position comprises the flange of the top panel having an interlocking portion interlockable with the flange of the bottom panel.

As can be appreciated, the construction of an ironing board according to the present invention allows to easily hide the hanging skirt of an ironing cloth. Thereby, in a storage position, the ironing cloth is not visible under the ironing board.

A non restrictive description of a preferred embodiment will now be given with reference to the appended drawings.

DESCRIPTION OF A PREFERRED EMBODIMENT

Figure 1:
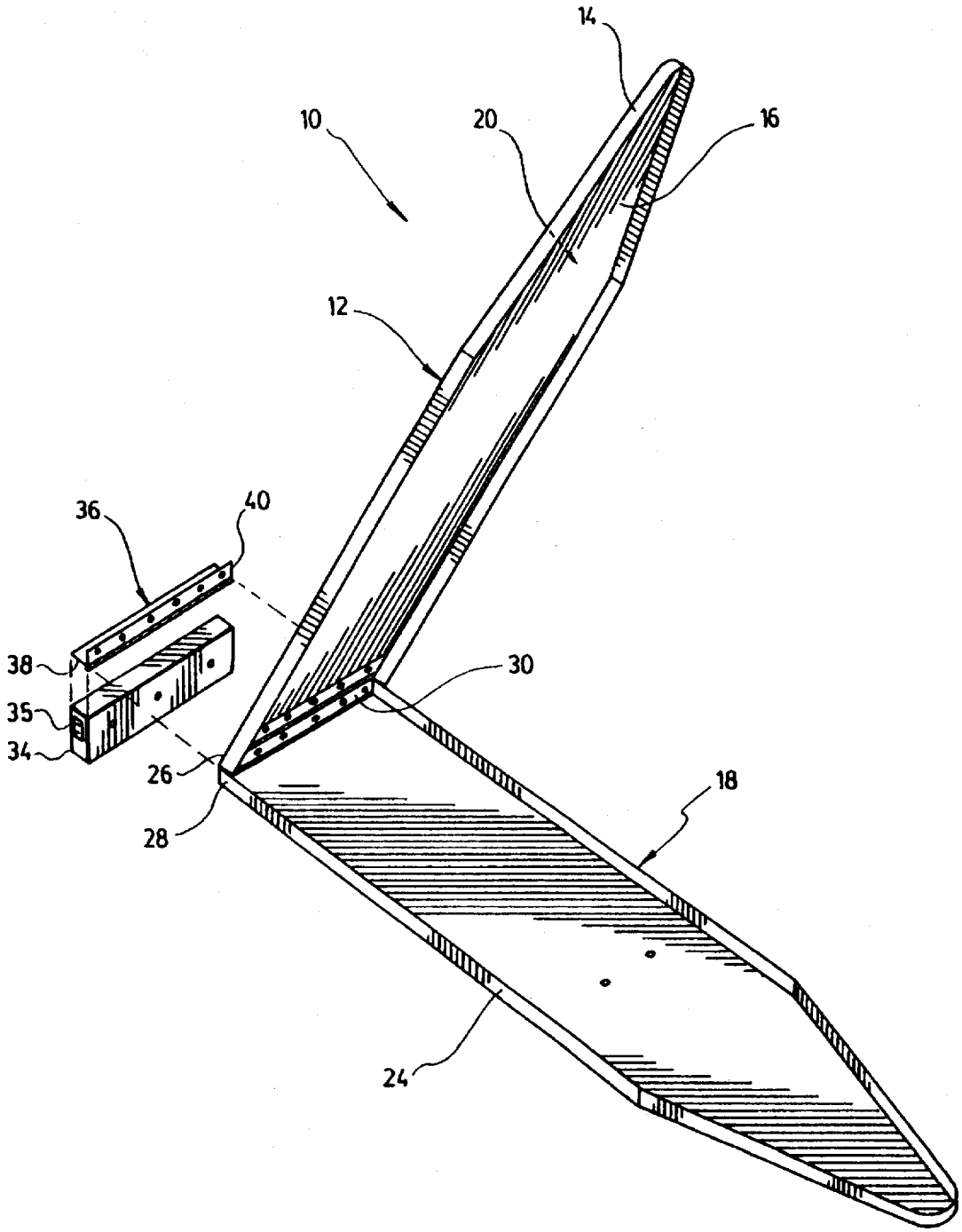
FIG. 1 is an exploded perspective view of an ironing board according to a preferred embodiment of the present invention, showing the first and second panel in an open position.

Referring to FIG. 1, the ironing board 10 comprises a first panel 12 provided with a peripheral flange 14 defining a housing underneath this first panel 12. The ironing board 10 also comprises a second panel 18 sized to closely fit into the housing 16 of the first panel 12. As illustrated, in this preferred embodiment, the first panel 12 constitutes the top panel of the ironing board 10 and is therefore also defining the working surface 20 of the board 10. In another preferred embodiment of the present invention (not illustrated), this first panel might have been the bottom panel of the ironing board disposed to receive the top panel in its housing. In this case, the working surface would have been defined by the second panel. For ease of understanding, we will now refer to the first panel and second panel as the top 12 and bottom panel 18 of the ironing board 10 respectively, which best correspond to the preferred embodiment illustrated in the figures.

Figure 3:
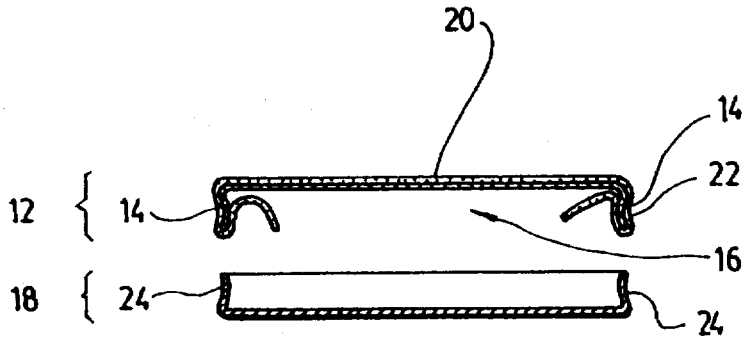
FIG. 3 is the same view as FIG. 2 showing the panels in an open position.
Figure 2:
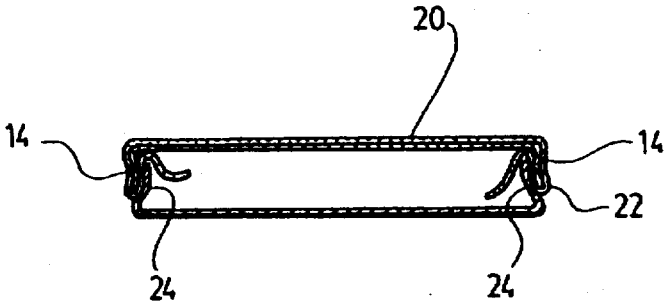
FIG. 2 is a cross-sectional view of the first and second panel along line II—II of FIG. 6.

Referring now to FIGS. 2 and 3, it can be seen that an ironing cloth 22, pad or the like skirting an outline of the ironing board 10, or of the working surface 20 of this ironing board 10, may be easily clamped between the bottom and top panel 12,18 when these panels are shut against each other. The construction of these panels 12,18 allows to neatly hide the hanging skirt of the ironing cloth 22. Thereby, as can be appreciated in FIG. 4, the ironing cloth is not visible under the ironing board 10 when it is in a storage position. A wall-mountable ironing board according to the present invention is thus aesthetically advantageous and it may be mounted anywhere in a house without requiring to hide it in a wardrobe.

As illustrated in FIGS. 2 and 3, the bottom panel 18 is preferably provided with a peripheral flange 24 projecting upwardly therefrom, thereby making the ironing board 10 hollow when the top 12 and bottom panel 18 are shut against each other in a closed position. This preferred embodiment of the invention allows to easily insert a long hanging skirt inside the hollow ironing board. In this case, the means for removably securing the bottom panel 18 to the top panel 12 in a closed position may comprise the flange of the top panel 14 having an interlocking portion interlockable with a corresponding interlocking portion of the flange of the bottom panel 18. Preferably, as illustrated in FIGS. 2 and 3, the flange of both the top and bottom panel 12,18 is concave, making them interlockable with each other.

In another preferred embodiment (not illustrated), the bottom panel may be a solid panel sized to tightly fit in the housing of the top panel.

Preferably, the ironing board 10 further comprises means for pivotally fastening the rear end 26 of the top panel 12 to a rear end 28 of the bottom panel 18 such that these panels are pivotable about their rear end between a closed position where the bottom panel 18 is extending in the housing 16 of the top panel 12, as illustrated in FIGS. 3 to 6, and an open position where the panels are defining an angle therebetween, as illustrated in FIG. 1.

Advantageously, a hinge means 30 or any other pivoting fastener known in the art may be used to pivotally fasten the panels 12,18 together.

Figure 4:
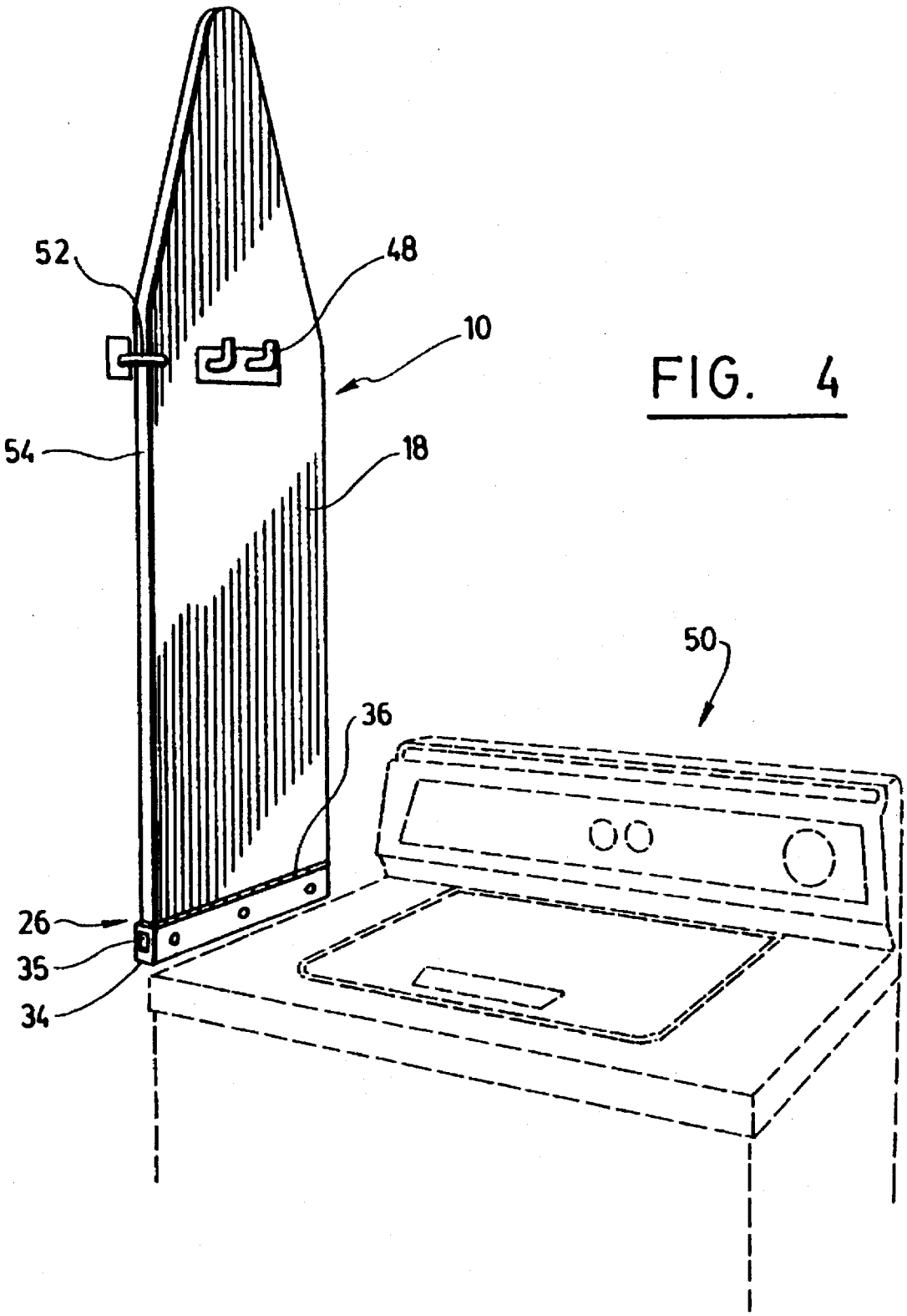
FIG. 4 is a perspective view of the ironing board illustrated in FIG. 1 mounted close to a drier in the vertical storage position.
Figure 5:
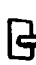
FIG. 5 is the same view as in FIG. 4 showing the ironing board in the horizontal service position.
Figure 5:
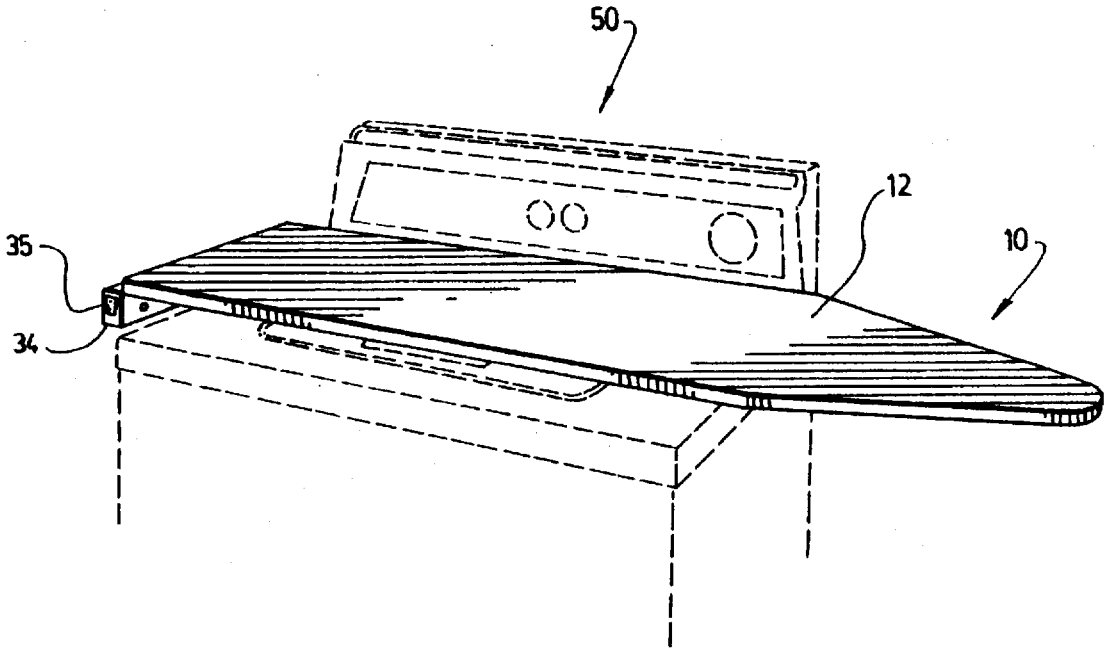
Figure 6:
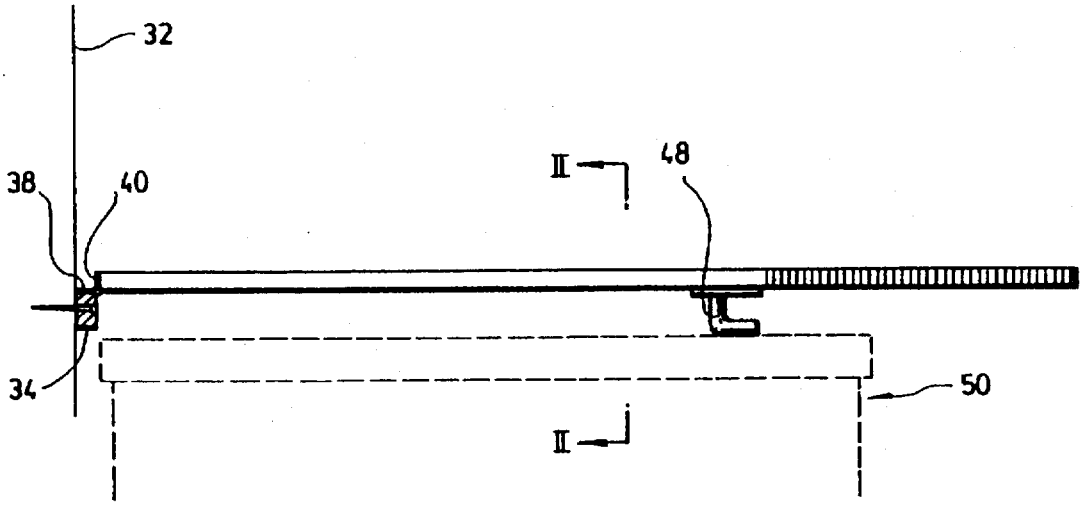
FIG. 6 is a side elevational view of the ironing board in the horizontal service position as in FIG. 3, showing the support member secured under the ironing board.

Referring now to FIGS. 1 and 4 to 6, the ironing board further comprises pivoting means for pivotally securing the rear end 26 of the top panel 12 to a wall 32 such that the ironing board 10 is pivotable between a service position where it is extending in a substantially horizontal position, as illustrated in FIGS. 5 and 6, and a storage position where it is extending in a substantially vertical position, as illustrated in FIG. 4. This pivoting means preferably comprises an elongated case 34 secured to the wall 32 and a hinge 36 having a first wing 38 secured to the case 34 and a second wing 40 secured to the rear end 26 of the top panel 12.

The ironing board 10 further comprises a support member 48 secured to the ironing board 10 under the bottom panel 18. This support member 48 is used for maintaining the ironing board 10 in the service position. Preferably, as illustrated in FIG. 6, the support member 48 simply consists of a pair of short supporting legs that may be laid on the upper surface of a drier 50, a washer, or any other elevated surface.

A hook 52 secured to the wall 32 and adapted to engage a side edge 54 of the ironing board 10 is also provided with the ironing board. This hook is used for locking the ironing board 10 in a vertical position for storage. Obviously, any other means for maintaining the ironing board either in a service position or a storage position known in the art may be used with the ironing board without departing from the scope of the present invention.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A wall-mountable ironing board for use with an ironing cloth, the ironing board comprising:

a top panel defining a working surface of the ironing board and comprising a peripheral flange defining a housing underneath;

a bottom panel sized to closely fit into the housing of the top panel and comprising a peripheral flange projecting upwardly therefrom;

means for removably securing the bottom panel to the top panel, said means comprising the flange of the top panel comprising an interlocking portion interlockable with a corresponding interlocking portion on the flange of the bottom panel;

pivoting means for pivotally securing a rear end of the top panel to a wall such that the ironing board is pivotable between a substantially horizontal position and a substantially vertical position;

means for maintaining the ironing board in the horizontal position; and means for locking the ironing board in the vertical position.

whereby an ironing cloth skirting the working surface is clampable between the top and bottom panel.

2. An ironing board in accordance with claim 1, further comprising means for pivotally fastening the rear end of the top panel to a rear end of the bottom panel such that these panels are pivotable about their respective rear ends between a closed position where the bottom panel is extending in the housing of the top panel and an open position where the panels are defining an angle therebetween.

3. An ironing board in accordance with claim 1, wherein each of the interlocking portions of the top and bottom panels is defined respectively by each of the flanges being concave.

4. An ironing board in accordance with claim 1, wherein the pivoting means comprises an elongated case secured to the wall and a hinge having a first wing secured to the case and a second wing secured to the rear end of the top panel.

5. An ironing board in accordance with claim 1, wherein the means for maintaining the ironing board in the horizontal position comprises a support member secured to the ironing board under the bottom panel.

6. An ironing board in accordance with claim 1, wherein the ironing board comprises a side edge and the means for removably locking the ironing board in the vertical position comprises a hook secured to the wall and adapted to engage the side edge of the ironing board.

7. A wall-mountable retractable ironing board which comprises:

a top panel comprising a peripheral flange defining a housing therebelow;

a bottom panel sized to closely fit into the housing of the top panel and being comprising a peripheral flange projecting upwardly therefrom, thereby making the ironing board hollow;

an ironing cloth covering the top panel and comprising a skirt clampable between the top and bottom panels;

means for removably securing the bottom panel to the top panel, said means comprising the flange of the top panel comprising an interlocking portion interlockable with a corresponding interlocking portion of the flange of the bottom panel;

means for pivotally securing a rear end of the top panel to a wall such that the ironing board is pivotable between a substantially horizontally position and a substantially vertical position;

means for maintaining the ironing board in the horizontal position; and means for removably locking the ironing board in the vertical position.

8. A wall-mountable retractable ironing board for use with an ironing cloth, said ironing board comprising:

a top panel having a rear end and a front end and being provided with a peripheral flange defining a housing underneath;

a bottom panel sized to closely fit into said housing of the top panel and being provided with a peripheral flange projecting upwardly therefrom, said flange of the bottom panel interlocking with the flange of the top panel and said bottom panel having a rear end pivotally fastened to the rear end of the top panel such that said panels are pivotable about their rear end between a closed position where the bottom panel is extending in the housing of the top panel and an open position where the panels are defining an angle therebetween;

pivoting means for pivotally securing a rear end of the top panel to a wall such that said ironing board is pivotable between a substantially horizontal position and a substantially vertical position;

a support member secured to the ironing board under the bottom panel for maintaining the ironing board in said horizontal position; and a hook secured to said wall and adapted to engage a side edge of the ironing board for removably locking the ironing board in said vertical position;

whereby an ironing cloth skirting the top panel is clampable between the top and bottom panel.

* * * * *